US006149333A

United States Patent [19]

Kershaw

[11] Patent Number: 6,149,333

[45] Date of Patent: Nov. 21, 2000

[54] WRITING INSTRUMENTS

[76] Inventor: Jason Bruce Kershaw, 1 Manfield Road, Ash, Aldershot, Hants, GU12 6NE, United Kingdom

[21] Appl. No.: 09/159,124

[22] Filed: Sep. 23, 1998

[30] Foreign Application Priority Data

Sep. 23, 1997 [GB] United Kingdom ..... 9720205
Feb. 6, 1998 [GB] United Kingdom ..... 9802538

[51] Int. Cl.[7] ..... B43K 23/00

[52] U.S. Cl. ..... 401/98; 401/195; 401/243

[58] Field of Search ..... 401/6, 88, 91, 401/243, 195, 52

[56] References Cited

U.S. PATENT DOCUMENTS

| | | | |
|---|---|---|---|
| D. 186,924 | 12/1959 | Lakatosh | D19/42 |
| D. 295,421 | 4/1988 | Young | 401/6 X |
| D. 318,293 | 7/1991 | Flowers | 401/6 X |
| D. 338,039 | 8/1993 | Takahashi | 401/6 X |
| 360,298 | 3/1887 | Hewitt | 401/6 X |
| 4,832,604 | 5/1989 | Rusk | 401/6 X |
| 5,061,105 | 10/1991 | Isoda | 401/243 X |
| 5,626,430 | 5/1997 | Bistrack | 401/6 |

OTHER PUBLICATIONS

Reader's Digest "House–Hold Hints and Handy Tips" Dec. 1988.

*Primary Examiner*—David J. Walczak
*Attorney, Agent, or Firm*—Lowe Hauptman Gopstein Gilman & Berner

[57] ABSTRACT

A ball-point pen which includes a shaft 16 which engages with balls 10 and 18 of rubbery elastic material at each end, ball 10 acting as the cap of the pen. When dropped or thrown, these balls will cause it to bounce in an entertaining fashion. The shaft 16 also has a relatively soft rubber sleeve 28.

8 Claims, 1 Drawing Sheet

WRITING INSTRUMENTS

FIELD OF THE INVENTION

The present invention relates to writing instruments, and in particular to a writing instrument of a novelty or somewhat toylike nature.

BACKGROUND OF THE INVENTION

There exists in the public at large, and in children especially, a large appetite for items which have both a mundane purpose and a more diversionary use. It is this need which the device addresses.

There are many types of pen and other such writing instruments which contain an entertaining element, often taking an unusual shape. There is, for instance, a pen whose shaft includes a hollow transparent portion, and terminates with a hollow transparent sphere containing numbered beads, so that a set number of beads may enter the shaft enabling random numbers to be picked for a lottery. Pens are also be formed to imitate fruit and vegetables such as carrots and bananas.

The general object of the present invention is to provide a novel and entertaining writing instrument.

SUMMARY OF THE INVENTION

According to the invention there is provided a writing instrument comprising:

a shaft having a writing end which is used for writing;

a cap, engageable with the writing end of the shaft, comprising an enlarged mass of elastic material; and a counter-cap comprising an enlarged mass of elastic material at the other end of the shaft.

When dropped or thrown the enlarged masses of resilient or elastic material at the ends of the pen will cause it to bounce in an entertaining fashion. Preferably the instrument comprises a shaft having a pair of highly elastic spheres mounted one at each end of the shaft.

It will of course be realized that although this structure has certain toylike characteristics, it also has functional utility, protecting the pen from damage when dropped, reducing or eliminating the danger of it falling through small holes or grilles if dropped, and making it virtually impossible to lose or for it to be taken away accidentally by a casual user.

BRIEF DESCRIPTION OF THE DRAWINGS

A writing instrument embodying the invention will now be described, by way of example, with reference to the drawings, in which.

DETAILED DESCRIPTION OF PREFERRED EMBODIMENT

Figure 1:
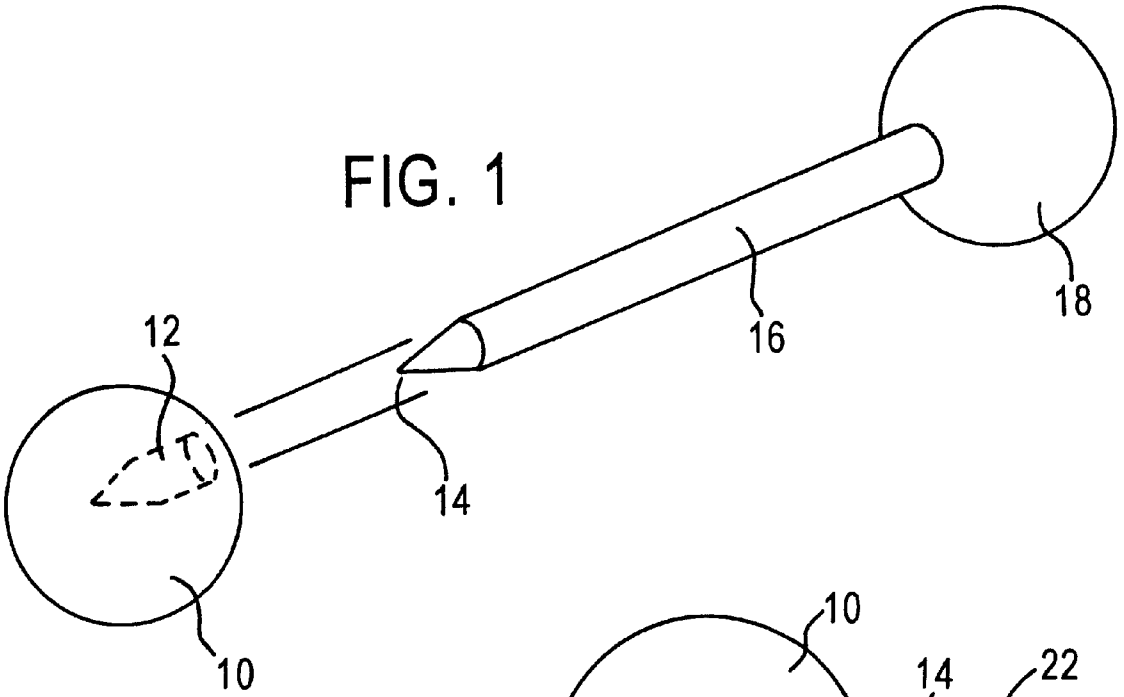
FIG. 1 is a simplified exploded view of the device.

Referring to FIG. 1, the system comprises a shaft 16 with a spherical cap 10 at one end and, at the other or counter end, a spherical extension or counter-cap 18 to the shaft. The shaft is similar to that of a conventional ball-point pen, being hollow and containing an ink reservoir tube and tapering at the end to a rollerball (ie the "ball" of a ball-point pen) 14. Obviously other types of pen, eg a fibre-tip, could be used.

A conventional pen cap is usually a tube with one end closed, having a diameter slightly larger than the shaft of the pen, and sometimes tapering towards the closed end so as to tightly fit the tapered shape of the pen. In the present device, however, the cap is formed from a sphere of highly elastic material, such as polyurethane rubber, having a diameter of around 30 mm, incorporating a hole 12 in which to accommodate the rollerball and the top of the pen shaft, which as with the conventional cap may taper to fit snugly to the tapered end of the pen.

Figure 2:
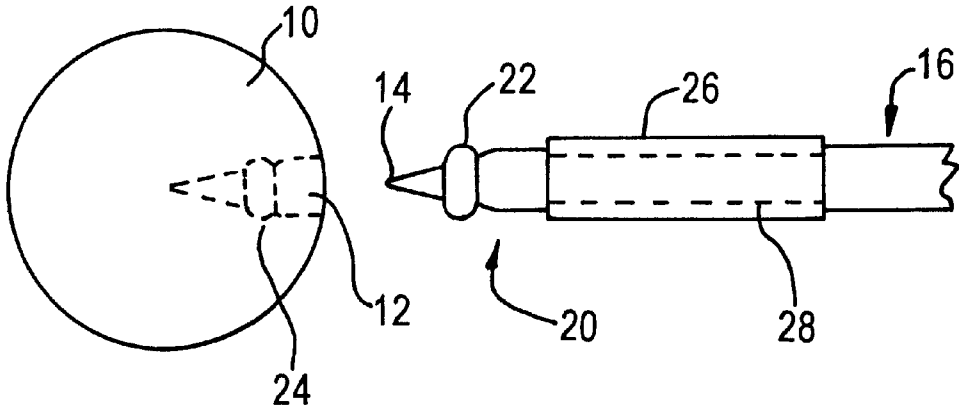
FIG. 2 is an exploded side view, partly in section, of the device.

FIG. 2 shows the structure is more detail. The pen shaft 16 has a tapering nose 20 which has a ridge 22 formed around it, and the rollerball 14 in the ball 12 has a corresponding groove 24 formed around it. This results in a more positive engagement of the ball with the shaft. Since the ball 12 is made of elastic material, it can be formed by molding in a mold with a peg having a ridge round it to form the rollerball 14, and pulled off the peg when formed. The other end of the shaft 16 and the ball is may be similar, though of course without a rollerball at that end.

The shaft 16 also carries a sleeve 26, which can conveniently be made of the same material as the balls 10 and 18. The shaft has a narrowed section, as indicated at 28, to help retain the sleeve 26 in position. This sleeve gives a more comfortable feel to the pen.

The balls 10 and 18 may be around 35 mm diameter, and the shaft 16 around 10 mm diameter and 130 mm long. The sleeve 26 may be around 40 mm long and 2 mm thick, with the narrowed section 28 around 8 mm diameter.

The balls or spheres 10 and 18, the shaft 16, and the sleeve 26 may be of various colors, such as a neutral or greyish color for the shaft and bright colors such as orange or red and green for the balls and sleeve. The spheres 10 and 18 may be of opaque material, but they can be made of transparent material, presenting an interesting and attractive appearance. If transparent material is used, it can have swirls or streamers of colored material (preferably with similar elasticity) incorporated, and/or it can have small decorative objects embedded in it.

Instead of a conventional rubber material, a material of the "silly putty" type may be used. For the present use, such material preferably has the following combination of characteristics: first, it is elastic (like ordinary rubber) in response to rapidly applied forces; second, it will deform in response to steadily applied forces (like "silly putty"); and third, it will retain a "memory" of its original shape so that after deformation by et steadily applied force, it will slowly return to its original shape when the applied forces are released.

When the pen cap is placed firmly over the pen nib and the whole pen is thrown or dropped on a flat rigid surface, it will land on one or both of the spheres, and so bounce back into the air. Thrown in a particular manner, one sphere will bounce slightly before the other, resulting in an unusual and unpredictable trajectory.

The writing mechanism and shaft of the pen should of course be manufactured from material which can withstand such treatment. A conventional ink reservoir is usually manufactured from a somewhat flexible end elastic material, and a shaft also having these characteristics would enhance the bouncing qualities of the pen.

The elastic spheres could of course be a different size from that here described, and need not both be the same size, Indeed, either end of the pen could be occupied by less regular shapes of generally polyhedral form, still possessing the necessary springiness whilst giving a more chaotic type of bounce.

The spheres or polyhedral shapes may be formed with indented surfaces, to give a different tactile sensation. There may be many small indentations, somewhat like the indentations on a golf ball, or a smaller number of larger indentations may be used.

Instead of indentations, the spheres or polyhedral shapes may be covered with protrusions. Such protrusions may be relatively low, ie pimple-like, or may be extended; in the latter case they can be described as hedgehog-like. The number of protrusions may be relatively small, eg around 10 or 12, but may be very considerably larger, forming a kind of bristle covering of the sphere.

Although the writing mechanism described here is that of a ball-point pen, it could equally use other writing mechanisms such as a fibre tip nib or a conventional fountain pen mechanism.

If the sphere forming the pen cap is of such a size that a child might swallow it, one or more channels through the sphere may be included so that the child's airway is not blocked.

An alternative embodiment comprises two spheres permanently affixed to the pen shaft, the pen's rollerball retractably protruding from one of the spheres, operated for example by a button on the side of the shaft. To use the pen, the ball at the rollerball end of the shaft is slid along the shaft to abut the ball at the other end. The sliding ball and pen shaft preferably have engagement means which prevent the ball from being slid off the shaft. The engagement means may comprise simply the surfaces of the pen shaft and the bore through the ball or sphere, with the bore being slightly expanded by the pen shaft through it and a frictional engagement resulting between these two surfaces.

The ball to is shown here as having a bore 12 into which the end of the pen 16 fits. Alternatively, a broadly conventional pen cap of the tapered cylinder type may be permanently fixed in the hole 12. The ball 18 may be attached in the same way as the ball 10, or it may be more firmly or permanently attached to the pen shaft.

It will be realized that with the present instrument, unlike conventional ones, the cap is very unlikely to become lost.

What is claimed is:

1. A writing instrument comprising:

a shaft having a writing end which is used for writing, said shaft being free of balls where the shaft is gripped by a user;

a cap, engageable with and covering the writing end of the shaft, comprising an enlarged mass of elastic material; and a counter-cap comprising an enlarged mass of elastic material at the other end of the shaft.

2. A writing instrument according to claim 1 wherein the cap and counter-cap are globular.

3. A writing instrument according to claim 1 wherein the shaft has a ridge around it at its writing end and the cap has a hole with a corresponding groove.

4. A writing instrument according to claim 1 wherein the shaft also carries a sleeve of elastic material.

5. A writing instrument according to claim 4 wherein the shaft has a narrowed section in which the sleeve is retained.

6. A writing instrument according to claim 1 wherein the elastic material is elastic in response to rapidly applied forces, deforms in response to steadily applied forces, and retains a "memory" of its original shape so that after deformation by a steadily applied force, it will slowly return to its original shape when the applied forces are released.

7. A method of protecting a pen from damage when dropped, the pen having opposite elastic end caps, comprising:

dropping the pen onto a surface;

self-orienting the pen during descent of the pen such that one of the elastic end caps strikes the surface;

bouncing the pen upwardly from the surface such that the elastic end cap absorbs most of the impact energy thereby protecting the pen from damage.

8. A method of dropping a pen, the pen having opposite elastic end caps, comprising:

dropping the pen onto a surface;

when one of the elastic end caps strikes the surface, the pen bounces from the one end cap to the other end cap in an entertaining manner.

* * * * *